US006550892B1

(12) United States Patent
Sharma

(10) Patent No.: US 6,550,892 B1
(45) Date of Patent: Apr. 22, 2003

(54) INK JET PRINTING WITH PRE-MIXED, COLOR-BALANCED INK DROPS

(75) Inventor: Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/005,579

(22) Filed: Nov. 12, 2001

(51) Int. Cl.[7] ..... B41J 2/21
(52) U.S. Cl. ..... 347/43; 347/15; 347/98
(58) Field of Search ..... 347/43, 15, 98, 347/96; 346/140.1

(56) References Cited

U.S. PATENT DOCUMENTS 4,382,262 A 5/1983 Savit
4,614,953 A 9/1986 Lapeyre
5,606,351 A 2/1997 Hawkins
6,055,004 A 4/2000 Fassler et al.
6,094,206 A * 7/2000 Hawkins ..... 347/43
6,097,406 A 8/2000 Lubinsky et al.

* cited by examiner

*Primary Examiner*—Lamson Nguyen
(74) *Attorney, Agent, or Firm*—Milton S. Sales

(57) ABSTRACT

According to a feature of the present invention, a drop-on-demand ink jet printing system for delivering droplets of selectable-color ink to a receiver includes a print head having at least one ink ejecting chamber. Each ejecting chamber has an associated nozzle opening through which ink droplets are delivered to the receiver. A conduit is in fluid communication with each of the ejecting chambers and a plurality of sources of color liquid ink. Each source (1) contains liquid ink of a different color and (2) communicates with the conduit. A source of colorless liquid ink also communicates with the conduit to provide a flow of colorless liquid ink into the conduit for delivery into the ejecting chambers. A flow controller is adapted to selectably meter ink from the sources of color liquid ink into the conduit between the source of colorless liquid ink and the ejecting chambers, whereby ink slugs of selectable color are prepared in the conduit by controlled delivery of selected amounts of different color inks. The slugs are separated one from another along the conduit by colorless liquid ink.

8 Claims, 2 Drawing Sheets

INK JET PRINTING WITH PRE-MIXED, COLOR-BALANCED INK DROPS

CROSS REFERENCE TO RELATED APPLICATIONS

Reference is made to commonly assigned, co-pending U.S. patent application Ser. No. 09/466,977 entitled CONTINUOUS COLOR INK JET PRINT HEAD APPARATUS AND METHOD, filed in the name of John A. Lebens on Dec. 17, 1999, and to my commonly assigned, co-pending U.S. patent applications Ser. No. 09/999,406 entitled INK JET PRINTING WITH COLOR-BALANCED INK DROPS MIXED USING COLORLESS INK and Ser. No. 10/002,665 entitled INK JET PRINTING WITH COLOR-BALANCED INK DROPS MIXED USING BLEACHED INK both filed on Oct. 31, 2001.

FIELD OF THE INVENTION

This invention relates generally to ink jet printing and, more particularly, to methods and apparatus for generating color balanced ink drops in a drop on demand ink jet printer.

BACKGROUND OF THE INVENTION

Ink jet printing is a prominent contender in the digitally controlled electronic printing arena in part because of its non-impact and low-noise characteristics, its use of plain paper, and its avoidance of toner transfers and fixing. Ink jet printing mechanisms can be categorized as either continuous ink jet or drop-on-demand ink jet.

Drop-on-demand ink jet printers selectively eject droplets of ink toward a printing media to create an image. Such printers typically include a print head having an array of nozzles, each of which is supplied with ink. Each of the nozzles communicates with a chamber, which can be pressurized in response to an electrical impulse to induce the generation of an ink droplet from the outlet of the nozzle. Many such printers use piezoelectric transducers to create the momentary pressure necessary to generate an ink droplet.

Drop-on-demand printers utilizing thermally-actuated paddles have also been suggested. Each paddle would include two dissimilar metals and a heating element connected thereto. When an electrical pulse is conducted to the heating element, the difference in the coefficient of expansion between the two dissimilar metals causes them to momentarily curl in much the same action as a bimetallic thermometer, only much quicker. A paddle is attached to the dissimilar metals to convert momentary curling action of these metals into a compressive wave that effectively ejects a droplet of ink out of the nozzle outlet.

Printing images in a plurality of colors is highly desirable. This has been effected by means of a plurality of streams of ink droplets emitted from a plurality of nozzles. However, the images produced in this way are in general binary in the sense that the number of colors available for each drop is limited to that of the number of associated ink reservoirs and nozzle sets.

Commonly assigned U.S. Pat. No. 5,606,351, which issued to Gilbert A. Hawkins on Feb. 25, 1997, discloses a system having the ability to control the intensity of color droplets by mixing two or more fluid ink components (dyes, pigments, etc.) drawn into a chamber from refill channels. As such, each ink ejector squirts an ink of a particular color of varying intensity and is not capable of altering the color. That is, only the tone of the color is altered.

Commonly assigned U.S. Pat. No. 6,097,406, which issued to Anthony A. Lubinsky et al. on Aug. 1, 2000, discloses an apparatus for mixing and ejecting mixed colorant drops. A mixing chamber receives the appropriate amounts of primary colors and a drop is ejected. However, a residual amount of dye is left in the chamber and needs to be removed by flushing with a clear cleaning fluid before the next color is prepared. A separate diluent chamber is used to control color density.

Commonly assigned, co-pending U.S. patent application Ser. No. 09/466,977 entitled CONTINUOUS COLOR INK JET PRINT HEAD APPARATUS AND METHOD, filed in the name of John A. Lebens on Dec. 17, 1999, discloses a scheme for color mixing in a continuous ink jet print head. By selectively restricting flow of two or more different color inks to a nozzle, a range of colored inks can be ejected from the nozzle.

U.S. Pat. No. 4,614,953, which issued to James M. Lapeyre on Sep. 30, 1986, discloses a color ink jet printing mechanism in which real time color mixing is achieved in a single channel. The method is said to be applicable to either drop-on-demand or continuous stream ink jet printer heads. According to the Lapeyre patent, the relative sizes of a mixing chamber line and its subsequent drive chamber mixed ink drive interior are such that a continuous flow of in is maintained without significant mixing or blurring of different colors suquentially provided within the ink flow.

U.S. Pat. No. 4,382,262, which issued to Joseph Savit on May 3, 1983, discloses a method for ink jet printing in which a first dye component is printed on a receiver. One of several complementary dye components is selectively provided by dedicated nozzles, thereby producing a selected color.

Commonly assigned U.S. Pat. No. 6,055,004, which issued to Werner Fassler et al. on Apr. 25, 2000, discloses a microfluidic printing array print head. Micropumps are used to deliver various colors into a nozzle area to create a drop of desired color. The colored drop is then transferred to a receiver by contact. A shutter plate is used to control ink flow.

DISCLOSURE OF THE INVENTION

According to a feature of the present invention, a drop-on-demand ink jet printing system for delivering droplets of selectable-color ink to a receiver includes a print head having at least one ink ejecting chamber. Each ejecting chamber has an associated nozzle opening through which ink droplets are delivered to the receiver. A conduit is in fluid communication with each of the ejecting chambers and a plurality of sources of color liquid ink. Each source (1) contains liquid ink of a different color and (2) communicates with the conduit. A source of colorless liquid ink also communicates with the conduit to provide a flow of colorless liquid ink into the conduit for delivery into the ejecting chambers. A flow controller is adapted to selectably meter ink from the sources of color liquid ink into the conduit between the source of colorless liquid ink and the ejecting chambers, whereby ink slugs of selectable color are prepared in the conduit by controlled delivery of selected amounts of different color inks. The slugs are separated one from another along the conduit by colorless liquid ink.

Advantages associated with the present invention include the ability to produce continuous tone images without the associated need to print with smaller drops to avoid image pixels being filled by only one drop. For example, the image pixel of a 300 dpi printer is approximately 84 micron square, requiring a 60 micron diameter drop for a spread factor of two when the drop impacts paper. The nozzle diameter may therefore be close to 60 microns. Such large nozzles are less likely to clog and therefore are more robust. Furthermore, large nozzles are easily cleaned. Large nozzles may also employ more viscous inks putting less demand on ink formulation.

The apparatus and method of controlling color by delivering premixed ink to print heads provides a unique means of obtaining color balance on demand. This method allows single drop per image pixel printing with any color of choice color with many levels of intensity.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
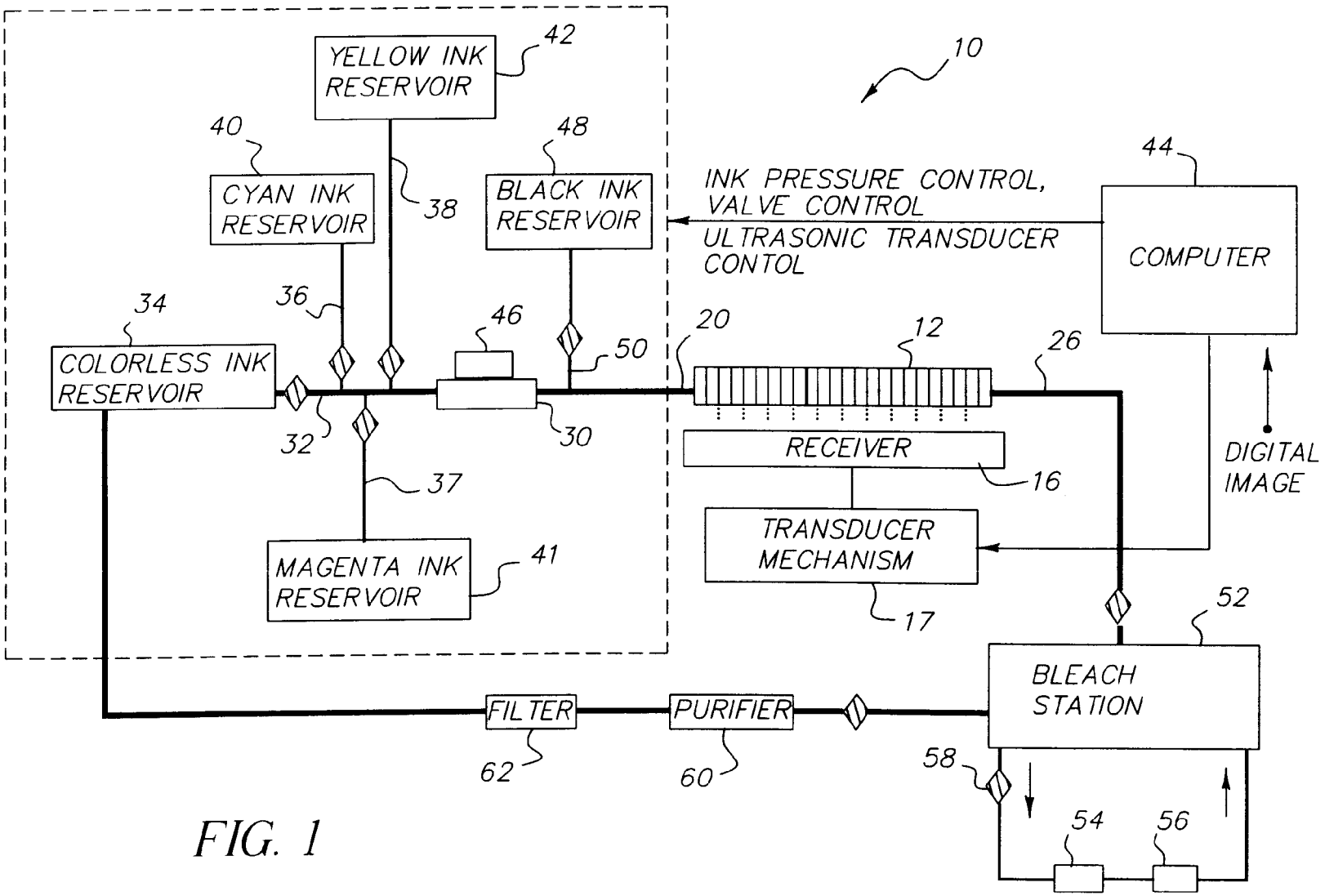
FIG. 1 is a schematic view of an ink jet printer according to a preferred embodiment of the present invention wherein a source of pre-mixed ink is connected to a mixing chamber.
Figure 2:
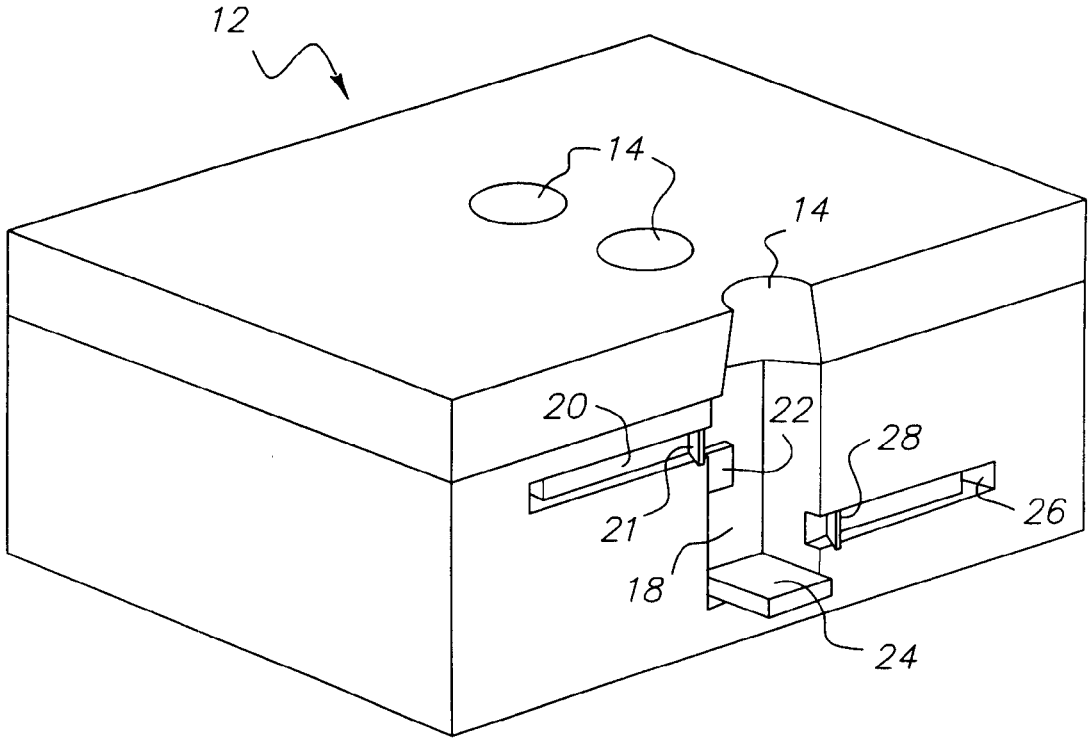
FIG. 2 is a perspective view of a print head suitable for use in the printer of FIG. 1.

Referring to FIGS. 1 and 2, an ink jet printer 10 uses a drop-on-demand print head 12 having a plurality of nozzle openings 14, best illustrated in FIG. 2, for delivering ink drops of selectable color to a receiver 16 moved relative to print head 12 by a computer-controlled transducer mechanism 17. Each nozzle opening 14 is in communication with an ink ejecting chamber 18 which receives selected quantities of fluid via a passage 20 controlled by a microvalve 21. Further mixing of the fluid in ejecting chamber 18 may be conducted by way of an optional mixer 22. Any device that causes a disturbance in the liquid present in the mixing chamber would function as a mixer. For example, mixer 22 may be a heater, piezoelectric transducer, micropump, thermally actuated flipper, piezoelectrically-driven flipper, or electrostatically driven vibrating plate.

Once the fluid is mixed, a drop is ejected by an ejector 24. The ejector provided in chamber 18 may be a resistor layer, such as TaAl, deposited of the floor of the mixing chamber. The resistive layer may be coated with an electrical passivation layer (e.g., SiNi and/or SiC) and also with a non-wetting passivation layer. When current is passed through the resistive layer, mixed fluid is rapidly heated, causing an expanding gas bubble to eject a drop of mixed fluid. Another type of ejector may be thermally-driven such as a bimetallic flipper paddle that bends toward nozzle opening 14 when energized with electricity. Heat released by the energized resistive strip causes differential expansion of one of the metallic layers in the bimetallic strip, causing the bimetallic paddle to flip rapidly and eject a drop of the mixed ink. Fluid not ejected through nozzle opening 14 may by removed from chamber 24 via a passage 26.

Fluid flow control in passages 20 and 26 may be effected by microvalves 21 and 28, respectively. Any of many forms of microvalve disclosed in the literature may be used in systems according to the present invention. For example, a bimetallically driven diaphram is disclosed in Understanding Microvalve Technology, 26 Sensors, September 1994. Other types of microvalves are disclosed in U.S. Pat. Nos. 5,178,190; 5,238, 223; 5,259,757; 5,367,878; 5,400,824; and 5,880,752.

Each inlet passage 20 (one of which is illustrated in FIG. 1) entering an ejecting chamber 18 may include a color mixing zone 30. Color mixing zone 30 is fed by a conduit 32 which carries a flow of colorless ink for a reservoir 34 past a series of valved inlets 36–38 for introducing cyan, magenta and yellow inks from reservoirs 40–42, respectively, into the flow. The reservoirs may be pressurized so that flow occurs once a valve is opened. Alternatively, a pump may be used to deliver liquid from the reservoirs to the mixing chamber. Any of many micropumps disclosed in the literature may be used to move fluid around the system, as for example, electroosmotic pumps, acoustic pumps, or piezoelectrically driven membrane pumps.

The color inks are inserted in the flow of colorless ink as distinct segments, herein referred to herein as "slugs." The slugs of color inks are preferably separated one from the other by a segment of colorless ink. It will be seen that the segments of colorless ink separating the slugs of color ink are useful to flush and clean out color residue in ejecting chamber 18.

As colorless ink progressed along conduit 32, slugs of color ink are prepared in-line by metering selected amounts of cyan, magenta and yellow inks into the conduit as the slugs pass valved inlets 36–38. The amount of each color to be metered is controlled image-wise by a computer 44 so that a color mixture corresponding to the color to be deposited on an image pixel is prepared by metering in the appropriate amount of dyes and colorless ink. As each slug travels through color mixing zone 30, the cyan, magenta and yellow ink components are encouraged to mix by an ultrasound transducer 46, by making the fluid travel along a tortuous path, or by other suitable mechanism. Of course, color mixing zone 30 may be eliminated, relying on mixer 22 for that function. On the other hand, it may be found that color mixing zone 30 is sufficient, and that mixer 22 may not be needed.

A slug of black ink from a reservoir 48 may be injected into the ink flow at a valved inlet 50. Black ink inlet 50 may, of course, be positioned upstream of mixing zone 30. This might be desirable to reduce the amount of color inks from reservoirs 40–42 by using just enough black ink to replace the sum of equal amounts of cyan, magenta and yellow ink components. When the slug arrives in ejecting chamber 18, it is ejected to create and image. Colorless ink arriving soon after the premixed slug cleans out the ejector chamber until the next premixed colored slug arrives.

The ink flushed is collected via passage 26 in a bleach station 52 where it is to be treated and converted to colorless ink by adding appropriate amounts of chemical bleach and colorless ink. Other bleaching methods such as thermal bleaching and photobleaching may be appropriate in particular circumstances. The bleach station is equipped with a bleach source, a mixing pump 54, a detector (dye and viscosity sensor) 56 and appropriate valves 58 to generate colorless ink, which is then cycled to colorless ink reservoir 34 for future use. A purifier 60 such as a bead pack may be used to remove breakdown products created by the bleaching process. The bleached and purified liquid may also be filtered at 62 before being returned to the colorless ink reservoir.

In the embodiment illustrated in FIG. 1, the flushed fluid is converted to colorless ink. Alternatively, the flushed fluid may be converted to black ink. In that case, the liquid may be treated with cyan, magenta and yellow dyes to create black ink to be returned to reservoir 48.

Examples of colorants which may be mixed to form ink may be one of many found in the literature. For example, a colored ink may be formed by mixing acid blue 6 (cyan), basic red 29 (magenta) and Zeneca yellow 132 (yellow). A bleach that may be used to reduce or eliminate color is a 5% solution of sodium hypochlorite. Other bleaches that may be used include acids, bases, ozone, hydrogen peroxide, and nucleophiles.

The invention has been described in detail with particular reference to preferred embodiments thereof, but it will be understood that variations and modifications can be effected within the spirit and scope of the invention.

What is claimed is:

1. An ink jet printing system for delivering droplets of selectable-color ink to a receiver; the system comprising:

a print head having at least one ink ejecting chamber;

a nozzle opening associated with each of the at least one ejecting chamber through which nozzle opening ink droplets are delivered from the associated ejecting chamber to the receiver;

a conduit in fluid communication with each of the at least one ejecting chamber;

a plurality of sources of color liquid ink, each source (1) containing liquid ink of a different color and (2) communicating with the conduit;

a source of colorless liquid ink communicating with the conduit to provide a flow of colorless liquid ink into the conduit for delivery into the at least one ejecting chamber;

a flow controller adapted to selectably meter ink from said sources of color liquid ink into the conduit between the source of colorless liquid ink and the at least one ejecting chamber, whereby ink slugs of selectable color are prepared in the conduit by controlled delivery of selected amounts of different color inks, said slugs being separated one from another along the conduit by colorless liquid ink; and an ejector associated with each of said ejecting chambers, the ejector being adapted to cause an ink droplet to be expelled from the ejecting chamber through the nozzle opening, wherein the ejector is a thermally-driven flipper paddle.

2. An ink jet printing system for delivering droplets of selectable-color ink to a receiver; the system comprising:

a print head having at least one ink ejecting chamber;

a nozzle opening associated with each of the at least one ejecting chamber through which nozzle opening ink droplets are delivered from the associated ejecting chamber to the receiver;

a conduit in fluid communication with each of the at least one ejecting chamber;

a plurality of sources of color liquid ink, each source (1) containing liquid ink of a different color and (2) communicating with the conduit; a source of colorless liquid, ink communicating with the conduit to provide a flow of colorless liquid ink into the conduit for delivery into the at least one ejecting chamber;

a flow controller adapted to selectably meter ink from said sources of color liquid ink into the conduit between the source of colorless liquid ink and the at least one ejecting chamber, whereby ink slugs of selectable color are prepared in the conduit by controlled delivery of selected amounts of different color inks, said slugs being separated one from another along the conduit by colorless liquid ink; and a mixer associated with each of said ejecting chambers to induce a disturbance in the liquid ink present in the ejecting chamber.

3. An ink jet printing system for delivering droplets of selectable-color ink to a receiver; the system comprising:

a print head having at least one ink ejecting chamber;

a nozzle opening associated with each of the at least one ejecting chamber through which nozzle opening ink droplets are delivered from the associated ejecting chamber to the receiver;

a conduit in fluid communication with each of the at least one ejecting chamber;

a plurality of sources of color liquid ink, each source (1) containing liquid ink of a different color and (2) communicating with the conduit;

a source of colorless liquid ink communicating with the conduit to provide a flow of colorless liquid ink into the conduit for delivery into the at least one ejecting chamber; and a flow controller adapted to selectably meter ink from said sources of color liquid ink into the conduit between the source of colorless liquid ink and the at least one ejecting chamber, whereby ink slugs of selectable color are prepared in the conduit by controlled delivery of selected amounts of different color inks, said slugs being separated one from another along the conduit by colorless liquid ink, wherein the flow controller is further adapted, using the colorless liquid ink separating slugs, to flush the at least one ejecting chamber with colorless ink after a droplet is delivered from the nozzle opening.

4. A drop-on-demand ink jet printing system as defined in claim 3 further comprising apparatus adapted to bleach flushed ink before returning it to the source of colorless ink.

5. A drop-on-demand ink jet printing system for delivering droplets of selectable-color ink to a receiver; the system comprising:

a print head having at least one ink ejecting chamber;

a nozzle opening associated with each of the at least one ejecting chamber through which nozzle opening ink droplets are delivered from the associated ejecting chamber to the receiver;

a conduit in fluid communication with each of the at least one ejecting chamber; a plurality of sources of color liquid ink, each source (1) containing liquid ink of a different color and (2) communicating with the conduit;

a source of colorless liquid ink communicating with the conduit to provide a flow of colorless liquid ink into the conduit for delivery into the at least one ejecting chamber;

a flow controller adapted to selectably meter ink from said sources of color liquid ink into the conduit between the source of colorless liquid ink and the at least one ejecting chamber, whereby ink slugs of selectable color are prepared in the conduit by controlled delivery of selected amounts of different color inks, said slugs being separated one from another along the conduit by colorless liquid ink; and a color mixing zone in the conduit between said sources of color liquid ink and the at least one ejecting chamber.

6. A process for delivering droplets of selectable-color ink to a receiver from a print head having at least one ejecting chamber and nozzle group; the process comprising:

communicating a source of colorless liquid ink with the at least one ejecting chamber through a conduit;

metering selected amounts of a plurality of liquid inks of a different color into the conduit between the source of colorless liquid ink and the at least one ejecting chamber to form ink slugs of selectable color in the conduit, said slugs being separated one from another along the conduit by colorless liquid ink; and flushing the at least one ejecting chamber with colorless ink after a droplet is delivered from the nozzle opening.

7. A process as defined in claim 6 wherein the colorless ink used for flushing is the colorless liquid ink separating slugs.

8. A process as defined in claim 6 further comprising the steps of:

bleaching flushed ink; and returning bleached flushed ink to the source of colorless ink.

* * * * *